US012427367B1

(12) United States Patent
Zhan

(10) Patent No.: US 12,427,367 B1
(45) Date of Patent: Sep. 30, 2025

(54) FOLDING FITNESS MAT

(71) Applicant: OGOGO INC

(72) Inventor: KaiGang Zhan, Zhejiang (CN)

(73) Assignee: Ogogo, Inc., Spokane, WA (US)

( * ) Notice: Subject to any disclaimer, the term of this patent is extended or adjusted under 35 U.S.C. 154(b) by 0 days.

(21) Appl. No.: 19/001,488

(22) Filed: Dec. 25, 2024

(30) Foreign Application Priority Data

Dec. 13, 2024 (CN) ..... 202423092303.9

(51) Int. Cl.
*A63B 21/00* (2006.01)

(52) U.S. Cl.
CPC ..... *A63B 21/4037* (2015.10); *A63B 2210/50* (2013.01)

(58) Field of Classification Search
CPC ..... A63B 21/4037; A63B 2209/00; A63B 2210/50; A63B 2225/09; A63B 2225/093
See application file for complete search history.

(56) References Cited

U.S. PATENT DOCUMENTS 5,417,636 A * 5/1995 Havens ..... A63B 21/0552 482/145
D444,550 S * 7/2001 Cobbs ..... D6/595
6,321,401 B1 * 11/2001 Fleming ..... A47C 27/001 5/722
9,675,151 B1 * 6/2017 MacNeil ..... A47G 29/083
10,933,277 B2 * 3/2021 Calvaruso ..... A63B 21/4037
D1,050,762 S * 11/2024 Borenstein ..... A63B 21/4037 D6/582
2008/0118671 A1 * 5/2008 Bienkiewicz ..... A63B 21/4037 428/12
2009/0255060 A1 * 10/2009 Biggs ..... A47G 9/062 482/142
2012/0233772 A1 * 9/2012 Wang ..... A63B 21/4037 5/417
2015/0297941 A1 * 10/2015 Fleming ..... A63B 21/4037 5/417
2017/0095690 A1 * 4/2017 Sharkey ..... A47G 27/0237
(Continued)

FOREIGN PATENT DOCUMENTS

CN 205516159 U * 8/2016
CN 205659314 U * 10/2016
(Continued)

*Primary Examiner* — Gary D Urbiel Goldner
(74) *Attorney, Agent, or Firm* — Scherrer Patent & Trademark Law, P.C.; Stephen T. Scherrer; Monique A. Morneault

(57) ABSTRACT

A folding fitness mat is provided, which includes a top surface and a bottom surface opposite to each other. The top surface is provided with one or more top surface broken line grooves across a width of the top surface. The bottom surface is provided with one or more bottom surface broken line grooves extending in a width direction of the folding fitness mat. Bump structures are respectively arranged at two opposite ends of each of the bottom surface broken line grooves. Each of the bump structures is connected to groove walls on both sides of each of the bottom surface broken line grooves in the width direction, respectively. The folding fitness mat can be folded crosswise along the top surface broken line grooves and the bottom surface broken line grooves to store as a small block, so that the folding fitness mat is conveniently stored and carried.

8 Claims, 6 Drawing Sheets

(56) References Cited

U.S. PATENT DOCUMENTS

| | | | | |
|---|---|---|---|---|
| 2017/0291059 | A1* | 10/2017 | Lin | A63B 21/4037 |
| 2018/0361193 | A1* | 12/2018 | Ross | A63B 21/4037 |
| 2019/0099654 | A1* | 4/2019 | Sobalvarro | A63B 21/4037 |
| 2021/0244991 | A1* | 8/2021 | Pickett | H01F 7/0252 |
| 2021/0275857 | A1* | 9/2021 | Christ | A63B 21/4037 |
| 2022/0280833 | A1* | 9/2022 | Spinuzza | A63B 21/4037 |
| 2023/0181964 | A1* | 6/2023 | Borenstein | A63B 21/4037<br>482/142 |
| 2024/0416172 | A1* | 12/2024 | Costa Ruiz | A63B 21/4037 |

FOREIGN PATENT DOCUMENTS

| | | | | |
|---|---|---|---|---|
| CZ | 37565 | U1 * | 12/2023 | A47G 9/06 |
| KR | 200483069 | Y1 * | 4/2017 | |
| KR | 20220002116 | U * | 8/2022 | |
| WO | WO-2024039813 | A1 * | 2/2024 | |

* cited by examiner

FOLDING FITNESS MAT

TECHNICAL FIELD

The present disclosure relates to the technical field of household supplies, and particularly relates to folding fitness mat.

BACKGROUND

As is well-known, as a common home-based leaning article, people can lie and sit on a soft mat to have a rest or do yoga for fitness without contacting with the ground directly. At present, the soft mat on the market is usually stored by way of a scroll or in a folding manner to reduce the volume. However, in the storing and folding processes, the soft mat is repeatedly folded and unfolded, and the same place of the soft mat is folded and unfolded, which easily enables the soft mat to be broken at the position.

SUMMARY

The present disclosure is to provide a folding fitness mat to solve the technical problem that the foldable and storable soft mat itself is easily broken at the folding position in the process being repeatedly folded and unfolded.

To solve the above technical problem, the present disclosure adopts the following technical solution:

The present disclosure provides a folding fitness mat, including a top surface and a bottom surface opposite to each other, where the top surface is provided with one or more top surface broken line grooves across the width of the top surface; the bottom surface is provided with one or more bottom surface broken line grooves extending in a width direction of the fitness mat; bump structures are respectively arranged at two opposite ends of each of the bottom surface broken line grooves; each of the bump structures is connected to groove walls on both sides of each of the bottom surface broken line grooves in a width direction, respectively; in a length direction of the folding fitness mat, the top surface broken line grooves and the bottom surface broken line grooves are arranged at intervals and in a staggered manner; and arc-shaped chamfered angles are arranged at four corners of the top surface.

In one of embodiments, distances between any adjacent top surface broken line grooves and bottom surface broken line grooves in the length direction of the folding fitness mat are equal.

In one of embodiments, in a thickness direction of the folding fitness mat, an end surface of each of the bump structures close to the bottom surface is sunken inward to form an arc-shaped end surface, and each of the bump structures does not protrude out of the bottom surface.

In one of embodiments, an inner side of each of the bump structures is in smooth connection to an inner wall surface of each of the bottom surface broken line grooves to form an arc-shaped chamfered angle.

In one of embodiments, groove walls on both sides of each of the bottom surface broken line grooves in a width direction are in smooth connection to the bottom surface to form an arc-shaped chamfered angle.

In one of embodiments, groove walls on both sides of each of the top surface broken line grooves in the width direction are in smooth connection to the top surface to form an arc-shaped chamfered angle.

In one of embodiments, a width size of a notch of each of the top surface broken line grooves is greater than a width size of a bottom wall of each of the top surface broken line grooves.

In one of embodiments, a width size of a notch of each of the bottom surface broken line grooves is greater than a width size of a bottom wall of each of the bottom surface broken line grooves.

In one of embodiments, a mat body of the folding fitness mat includes a foamed material layer, the foaming material layer including any one of PE, XPE, IXPE, EVA, TPE or POE.

In one of embodiments, there are a plurality of foamed material layers, the plurality of foamed material layers being laminated in sequence to form the mat body of the folding fitness mat.

It can be known from the technical solution that the embodiments of the present disclosure at least have the advantages and positive effects:

According to the folding fitness mat provided in the embodiment of the present disclosure, the top surface broken line grooves and the bottom surface broken line grooves are arranged at intervals and in a staggered manner in the top surface and the bottom surface, respectively, so that it is convenient for the user to fold and store the folding fitness mat. In addition, both ends of each of the bottom surface broken line grooves are provided with the bump structures in the length extension direction thereof. Both ends of each of the bump structures are connected to groove walls on both sides corresponding to the width direction of each of the broken line grooves to enhance the connecting strength of the mat bodies of the folding fitness mat at the positions of the broken line grooves, so as to prevent the folding fitness mat from being damaged due to wearing at the positions of the broken line grooves in the process that the user folds and stores the folding fitness mat repeatedly, thereby prolonging service life of the whole folding fitness mat. The arc-shaped chamfered angles are arranged at four corners of the top surface to prevent sharp corner angles, and meanwhile, the folding fitness mat further has the sense of beauty.

DETAILED DESCRIPTION OF THE DRAWINGS

To more clearly illustrate the embodiments of the present disclosure or the technical solutions in the prior art, the accompanying drawings required in the embodiments will be briefly introduced below. It is apparent that the drawings in the following description are only some embodiments of the present disclosure, and for those of ordinary skill in the art, other drawings can also be obtained according to these drawings without making creative efforts.

Figure 1:
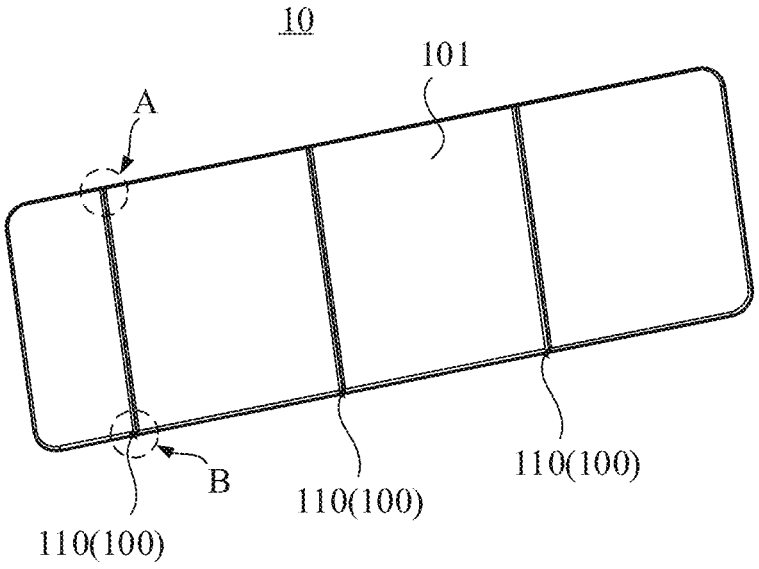
FIG. 1 is an overall schematic structural diagram of a folding fitness mat in an embodiment of the present disclosure.

Reference numerals are illustrated as follows:

10, folding fitness mat; 101, top surface; 102, bottom surface; 100, broken line groove; 110, top surface broken line groove; 111, groove wall of the top surface broken line groove; 120, bottom surface broken line groove; 121, groove wall of the bottom surface broken line groove (inner wall surface of the bottom surface broken line groove); 200, bump structure; 201, inner side of the bump structure; 210, arc-shaped end surface; 300, foamed material layer; 400, protective cover; C1, arc-shaped chamfered angle arranged at four corner of the top surface; C2, arc-shaped chamfered angle at the bump structure; C3, arc-shaped chamfered angle at the bottom surface broken line grooves; C4, arc-shaped chamfered angle at the top surface broken line groove.

DETAILED DESCRIPTION OF THE EMBODIMENTS

Exemplary embodiments that embody the features and advantages of the present disclosure will be described in detail in the following description. It will be appreciated that the present disclosure may have various changes in different embodiments without departing from the scope of the present disclosure, and that the description and drawings are illustrative in nature and are not intended to limit the present disclosure.

In addition, the terms "first" and "second" are merely used for descriptive purposes and cannot be construed as indicating or implying relative importance or implicitly specifying the number of indicated technical features. Thus, a feature defined with "first" or "second" can explicitly or implicitly include at least one of the features. In the description of the present disclosure, "plurality" means two or more, unless expressly specified otherwise.

In the description of the present disclosure, it should be noted that unless otherwise specified and defined, the terms "mounting", "connecting" and "connection" should be understood in a broad sense, for example, "mounting", "connecting" and "connection" can be either fixed connection or detachable connection or integrated connection; can be either mechanical connection or electric connection; and can be either direct connection or indirect connection via an intermediation or internal communication of two components. Those of ordinary skill in the art can understand specific meanings of these terms in the embodiments as appropriate to specific situations.

Referring to FIGS. 1-12, the present disclosure provides a novel folding fitness mat 10. The folding fitness mat 10 is provided with a plurality of broken line grooves 100, so that a user can overturn the folding fitness mat 10 at the positions of the broken line grooves 100, and therefore, the whole folding fitness mat 10 can be switched between an unfolded state and a stored state. The area of plane of the folding fitness mat 10 in the unfolded state is very large, and the user can lie on the folding fitness mat to have a rest or perform fitness operations such as yoga and bodybuilding exercise. After the folding fitness mat 10 is folded and stored, a doubled thickness can be obtained, so that the using functions of the mat are diversified. The mat can not only be used as a fitness seat cushion and a yoga kneeler, but also can be used in various application scenarios such as a garden kneeler, an outdoor seat cushion and a kitchen mat. Therefore, a life style with the multipurpose mat is realized. Moreover, after being folded, the folding fitness mat 10 becomes a small block which is conveniently carried and further shortens the storage time. The user can fold, bag and store the folding fitness mat 10 when it is not used.

Referring to FIGS. 1-9, the folding fitness mat 10 includes a top surface 101 and a bottom surface 102 opposite to each other along the thickness thereof. The top surface 101 is provided with top surface broken line grooves 110, and the bottom surface 102 is provided with bottom surface broken line grooves 120. The top surface broken line grooves 110 and the bottom surface broken line grooves 120 are arranged at intervals and in a staggered manner in a length extension direction of the folding fitness mat 10. The top surface broken line grooves 110 and the bottom surface broken line grooves 120 are opened reversely along a thickness direction of the folding fitness mat 10, and the length extension directions of the top surface broken line grooves 110 and the bottom surface broken line grooves 120 are parallel to each other and are parallel to the width extension direction of the folding fitness mat 10.

Referring to FIG. 1, FIG. 2, FIG. 10, and FIG. 11, arc-shaped chamfered angles are arranged at four corners of the top surface 101 to avoid sharp corner angles which affect the using experience of the user, and folding fitness mat further has the sense of beauty.

Figure 6:
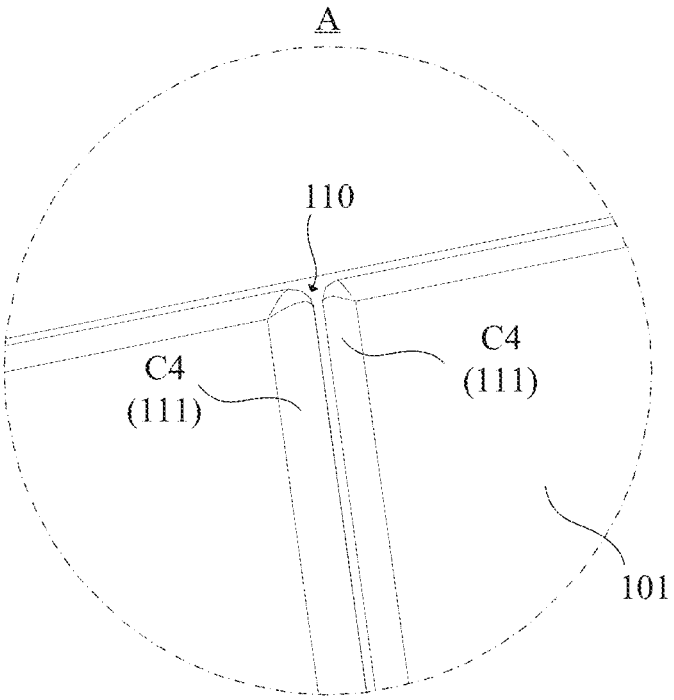
FIG. 6 is an enlarged schematic structural diagram of A shown in FIG. 1.
Figure 7:
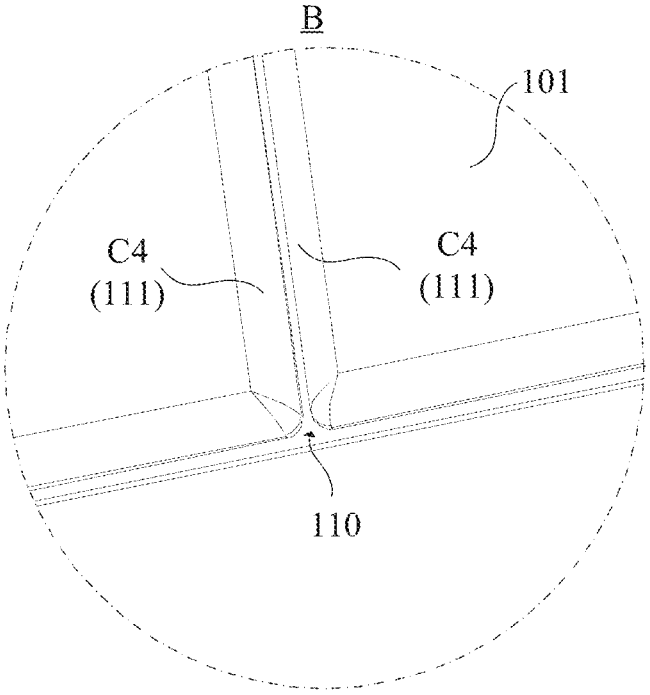
FIG. 7 is an enlarged schematic structural diagram of B shown in FIG. 1.
Figure 8:
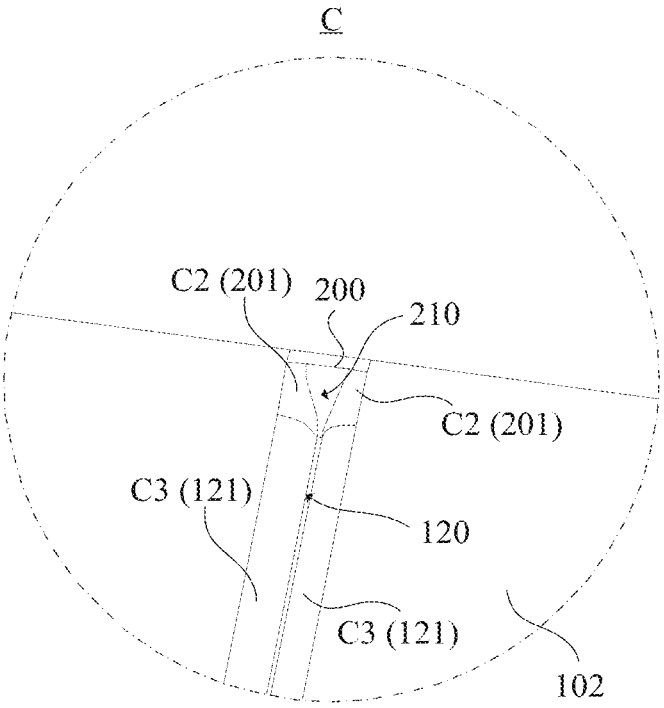
FIG. 8 is an enlarged schematic structural diagram of C shown in FIG. 1.

Referring to FIG. 1, FIG. 6, and FIG. 7, FIG. 6 and FIG. 7 are partially enlarged views of the top surface broken line grooves 110. Groove walls on both sides in the width directions of the top surface broken line grooves 110 are in smooth connection to the top surface 101 to form arc-shaped chamfered angles. The design of the chamfered angles further facilitates folding of the folding fitness mat 10 at the top surface broken line grooves 110.

Figure 2:
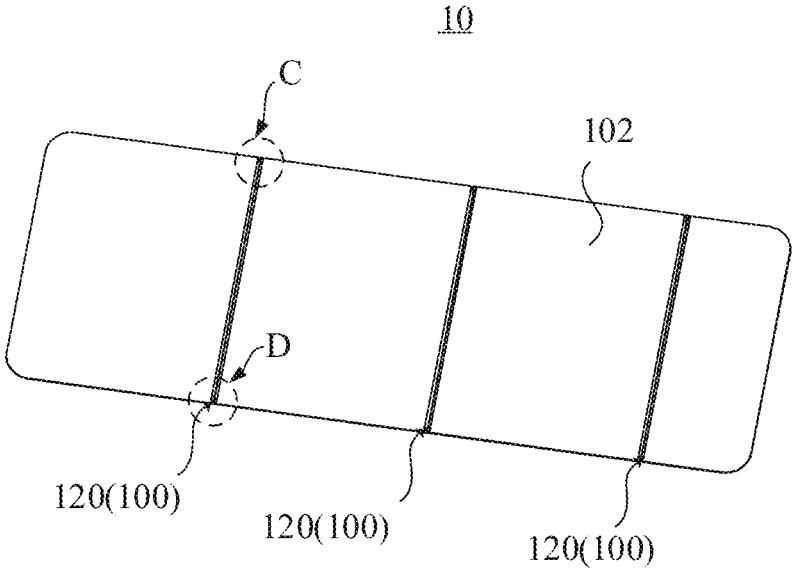
FIG. 2 is an overall schematic structural diagram of the folding fitness mat shown in FIG. 1 at a vertical inclined viewing angle.
Figure 3:
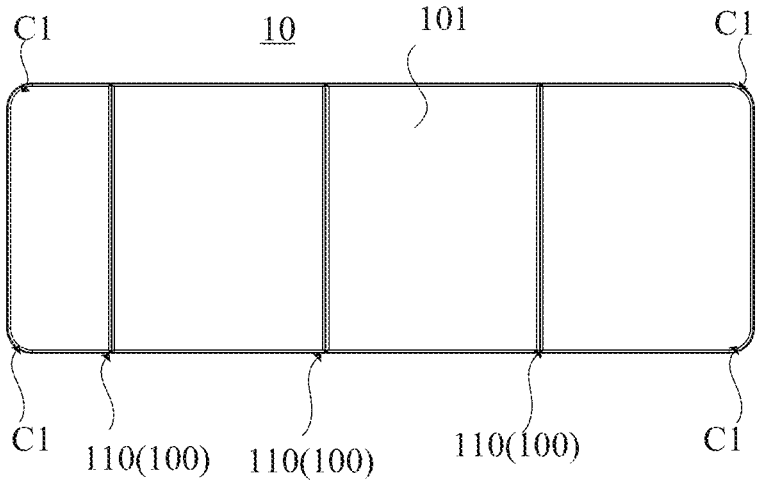
FIG. 3 is a top view of the folding fitness mat shown in FIG. 1.
Figure 4:
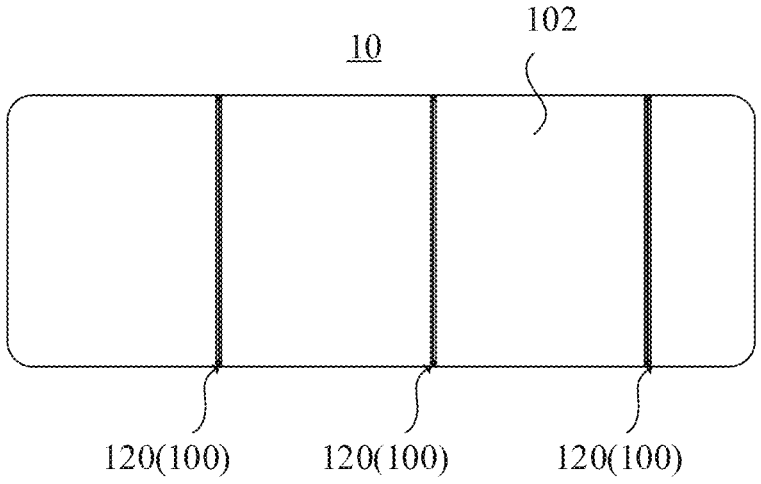
FIG. 4 is a vertical view of the folding fitness mat shown in FIG. 1.
Figure 5:
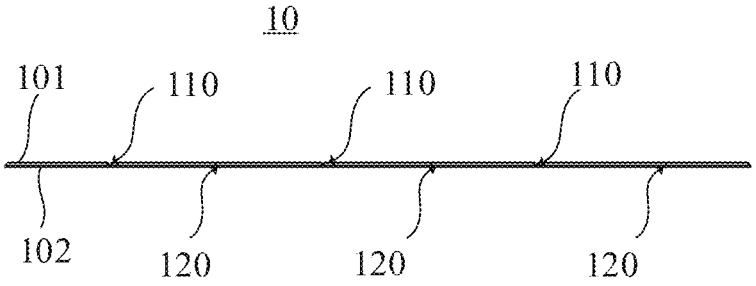
FIG. 5 is a front view of the folding fitness mat shown in FIG. 1.
Figure 9:
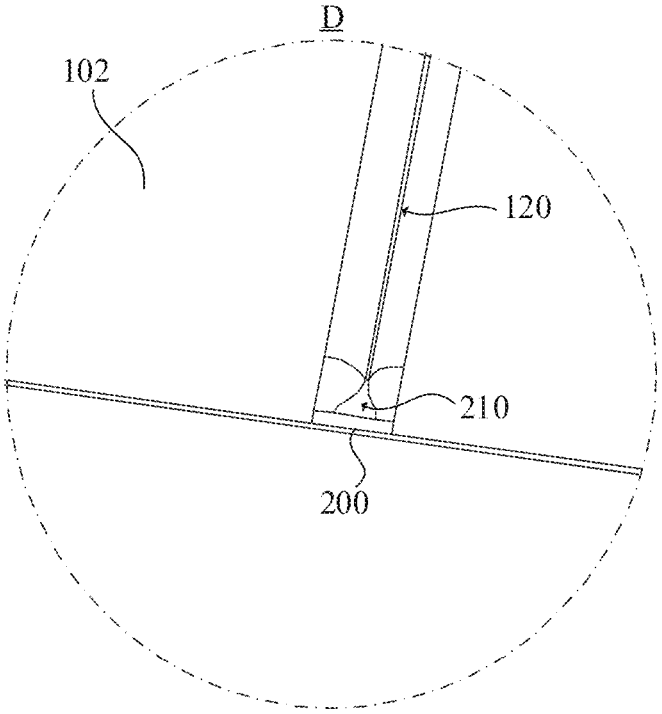
FIG. 9 is an enlarged schematic structural diagram of D shown in FIG. 1.
Figure 10:
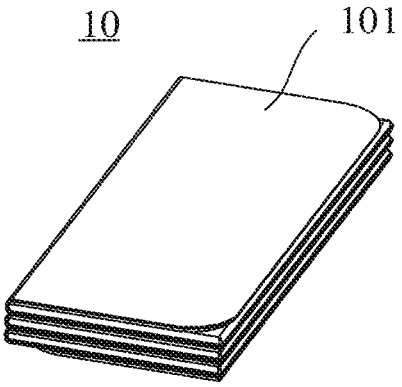
FIG. 10 is another state diagram of the folding fitness mat shown in FIG. 1.
Figure 11:
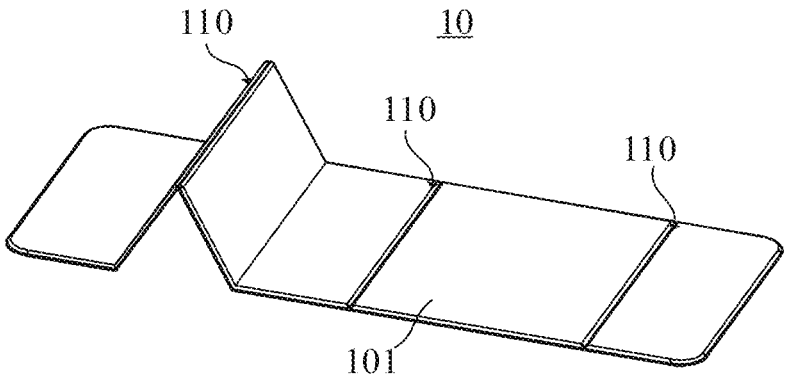
FIG. 11 is a yet another state diagram of the folding fitness mat shown in FIG. 1.
Figure 12:
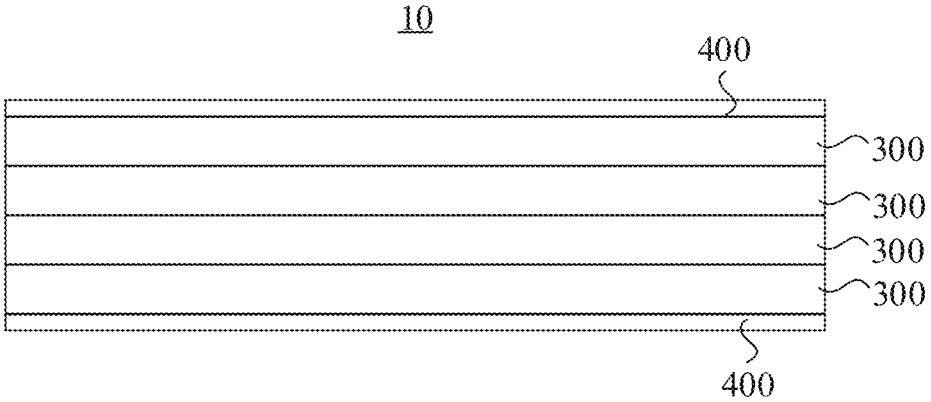
FIG. 12 is a schematic structural diagram of layers of a material of a folding fitness mat.

Referring to FIG. 2, FIG. 12, and FIG. 9, FIG. 12 and FIG. 9 are partially enlarged views of the bottom surface broken line grooves 120. Bump structures 200 are arranged at ends of each of the bottom surface broken line grooves 120 in the length extension direction thereof. Both ends of each of the bump structures 200 are connected to the groove walls on two opposite sides corresponding to the broken line grooves 100 (the top surface broken line grooves 110 and the bottom surface broken line grooves 120) in the width direction thereof, respectively, to enhance the connecting strength at the ends of the broken line grooves 100, so as to prevent the folding fitness mat 10 from being torn.

In the embodiment, the bump structures 200 are arranged at two opposite sides of each of the bottom surface broken line grooves 120 in the length extension direction thereof, each of the top surface broken line grooves 110 is provided with the bump structures 200, the top surface broken line grooves 110 further facilitate folding of the folding fitness mat 10, and the bottom surface broken line grooves 120 enhance the connecting strength of the folding fitness mat 10, so as to prevent the folding fitness mat from being damaged. It is to be understood that in other embodiments, the bump structures 200 can only be arranged on the top surface broken line grooves 110, or irrespective of the folding smoothness, the bump structures 200 can also be arranged at the ends of the top surface broken line grooves 110 and the bottom surface broken line grooves 120. The arrangement positions of the bump structures 200 are not limited in the present disclosure as long as they are arranged at the ends of the broken line grooves 100 to enhance the connecting strength.

In an embodiment, referring to FIGS. 1-4, there are a plurality of top surface broken line grooves 110 and bottom surface broken line grooves 120 uniformly arranged. Distances between any adjacent top surface broken line grooves 110 and bottom surface broken line grooves 120 in the length direction of the folding fitness mat 10 are equal, so that the whole folding fitness mat 10 is folded neatly and compactly. It is to be understood that irrespective of neat storage of the folding fitness mat 10, the numbers and adjacent distances of the top surface broken line grooves 110 and bottom surface broken line grooves 120 are not limited.

In an embodiment, referring to FIG. 12 and FIG. 9, in the thickness direction of the folding fitness mat 10, an end surface of each of the bump structures 200 close to the bottom surface 102 is sunken inward to form an arc-shaped end surface 210, and each of the bump structures 200 does not protrude out of the bottom surface 102. Here, the design of the arc-shaped end surface 210 facilitates folding of the folding fitness mat 10 at the bottom surface broken line grooves 120, and each of the bump structures 200 does not protrude out of the bottom surface 102, which improves the storage compactness of the folding fitness mat 10. It is to be understood that in the present disclosure, irrespective of the folding and storage compactness, the shape of the bump structures 200 is not limited as long as they can be connected to inner side walls of the bottom surface broken line grooves 120.

In an embodiment, referring to FIG. 12 and FIG. 9, an inner side of each of the bump structures 200 is in smooth connection to an inner wall surface (including a groove bottom wall and a groove side wall) of each of the bottom surface broken line grooves 120 to form an arc-shaped chamfered angle. Such design further enhances the connecting strength of the bump structures 200 at the ends of the bottom surface broken line grooves 120. It is to be understood that in the present disclosure, on the premise that the connecting strength of the bump structures 200 is large enough, whether the inner side of each of the bump structures 200 is in smooth connection to the inner wall surface of each of the bottom surface broken line grooves 120 is not limited.

In an embodiment, groove walls on both sides in the width directions of the top surface broken line grooves 120 are in smooth connection to the top surface 102 to form arc-shaped chamfered angles. The design of the chamfered angles further facilitates folding of the folding fitness mat 10 at the bottom surface broken line grooves 120.

It is to be noted herein that the top surface broken line grooves 110 and the bottom surface broken line grooves 120 are arranged, so that the whole folding fitness mat 10 can be randomly folded in a positive and negative alternating manner at the positions of the broken line grooves 100.

In an embodiment, referring to FIGS. 6-9, a width size of a notch of each of the top surface broken line grooves 110 is greater than a width size of a bottom wall of each of the top surface broken line grooves 110. A width size of a notch of each of the bottom surface broken line grooves 120 is greater than a width size of a bottom wall of each of the top surface broken line grooves 110. The top surface broken line grooves 110 and the bottom surface broken line grooves 120 both are in a state of being wide on the upper side and narrow on the lower side. Moreover, a side wall area of each of the top surface broken line grooves 110 from the notch to the groove bottom is in arc-shaped transition. Such design is to provide an overturning gap for the whole folding fitness mat 10 to prevent two mat bodies at the positions of the top surface broken line grooves 110 and the bottom surface broken line grooves 120 from being worn. In addition, due to the up-wide and low-narrow arc-shaped transition design, regardless of unfolding and folding processes of the folding fitness mat 10, two opposite inner side walls of the top surface broken line grooves 110 or the bottom surface broken line grooves 120 will not contact with each other to wear or slightly contact with each other to reduce wear. It is to be understood that irrespective of wear, the width sizes of the top surface broken line grooves 110 or bottom surface broken line grooves 120 are not limited.

In an embodiment, the mat body of the folding fitness mat 10 includes a foamed material layer 300, the foaming material layer including any one of PE, XPE, IXPE, EVA, TPE or POE or including a mixture thereof. It is to be noted that PE, XPE, IXPE, EVA, TPE or POE are elastic foamed materials (the foaming ratio is over one time). They all are closed cell foamed materials which have excellent impact resistance, rebound resilience, flexibility, sound insulation, heat insulation, waterproofness, non-toxicity, environmental friendliness and the like. The above elastic foamed material can improve the comfort level of the user lying and sitting on the folding fitness mat 10. It is to be understood that irrespective of the comfort level, the material of the mat body of the folding fitness mat 10 provided by the present disclosure is not limited.

In an embodiment, referring to FIG. 12, there are a plurality of foamed material layers 300, and the plurality of foamed material layers 300 are laminated in sequence to form the mat body of the folding fitness mat 10. Here, the colors of the foamed material layers 300 can be either same or different. It is to be understood that in the present disclosure, the number of layers of the foamed material layers 300 is not limited.

In an embodiment, referring to FIG. 12, in the embodiment, the folding fitness mat 10 further includes a protective cover 400. The protective cover 400 coats the outer surface of the foamed material layer 300 to prevent the foamed material layer 300 from being eroded by an external environment. On the other hand, the protective cover further can compact and tighten the foamed material to enhance the folding fitness mat 10. Here, the protective cover 400 is made of a three-proof fabric or leather and has antifouling, grease-proof and waterproof functions, so that the outer surface of the folding fitness mat 10 is easily kept clean and the using comfort level and sanitation of the user are improved. It is to be understood that in the present disclosure, whether the protective cover 400 is arranged and the material of the protective cover 400 are not limited.

In addition, production and processing courses of single-layered mats and multilayered mats in the embodiments of the present disclosure are simply described. The mats herein refer to the above-mentioned foamed material layers 300.

A folding effect of the single-layered mats is obtained by upper and lower grinding apparatuses at the same time, a specific process being as follows: a production process for the single-layered mats is as follows: PE, XPE, IXPE, EVA, TPE or POE raw materials are foamed first to form bulky elastomers; after the foamed materials are cooled, the foamed materials are sliced; then the sliced foamed materials are heated and softened; and finally, the heated and softened foamed materials are placed in cooled dies for cold press molding through a pressure of a machine, and then are cut into products by a cutting die after being finalized.

A production process for the multilayered mats is as follows: PE, XPE, IXPE, EVA, TPE or POE raw materials are foamed first to form bulky elastomers; after the foamed materials are cooled, the foamed materials are sliced; the sliced foamed materials are compounded in multiple layers in different manners; then the composite material is heated and softened; and finally, the heated and softened foamed materials are placed in cooled dies for cold press molding through a pressure of a machine, and then are cut into products by a cutting die after being finalized.

According to the folding fitness mat 10 provided in the embodiment of the present disclosure, the top surface broken line grooves 110 and the bottom surface broken line grooves 120 are arranged at intervals and in a staggered manner in the top surface 101 and the bottom surface 102, respectively, so that it is convenient for the user to fold and store the folding fitness mat 10. In addition, the ends of at least one of the top surface broken line grooves 110 and the bottom surface broken line grooves 120 are provided with the bump structures 200 in the length extension direction thereof. Both ends of each of the bump structures 200 are connected to groove walls on both sides corresponding to the width direction of the corresponding broken line grooves 100 to enhance the connecting strength of the mat bodies of the folding fitness mat 10 at the positions of the broken line grooves 100, so as to prevent the folding fitness mat 10 from being damaged due to wearing at the positions of the broken line grooves 100 in the process that the user folds and stores the folding fitness mat 10 repeatedly, thereby prolonging service life of the whole folding fitness mat.

Although the present disclosure has been described with reference to several typical embodiments, it should be understood that the terms used are illustrative and exemplary terms rather than restrictive terms. As the disclosure can be implemented specifically in various forms without departing from spirit or essence of the present disclosure, it should be understood that the embodiments are not limited to any above-mentioned details but should be explained extensively in the spirit and scope of the attached claims, and therefore, all variations and modifications falling within the claims or equivalent ranges thereof should be covered by the attached claims.

What is claimed is:

1. A folding fitness mat, comprising a top surface and a bottom surface opposite to each other, wherein the top surface is provided with one or more top surface broken line grooves across a width of the top surface; the bottom surface is provided with one or more bottom surface broken line grooves extending in a width direction of the folding fitness mat; bump structures are respectively arranged at two opposite ends of each of the bottom surface broken line grooves; each of the bump structures is connected to groove walls on opposing sides of each of the bottom surface broken line grooves in a width direction, respectively; in a length direction of the folding fitness mat, the top surface broken line grooves and the bottom surface broken line grooves are arranged at intervals and in a staggered manner; and arc-shaped chamfered angles are arranged at four corners of the top surface.

2. The folding fitness mat according to claim 1, wherein distances between any adjacent top surface broken line grooves and bottom surface broken line grooves in the length direction of the folding fitness mat are equal.

3. The folding fitness mat according to claim 1, wherein in a thickness direction of the folding fitness mat, an end surface of each of the bump structures close to the bottom surface is sunken inward to form an arc-shaped end surface, and each of the bump structures does not protrude out of the bottom surface.

4. The folding fitness mat according to claim 1, wherein an inner side of each of the bump structures is in smooth connection to an inner wall surface of each of the bottom surface broken line grooves to form an arc-shaped chamfered angle at each of the bump structures.

5. The folding fitness mat according to claim 3, wherein groove walls on the opposing sides of each of the bottom surface broken line grooves in the width direction are in smooth connection to the bottom surface to form an arc-shaped chamfered angle at each of the groove walls on the opposing sides of each of the bottom surface broken line grooves the width direction, respectively.

6. The folding fitness mat according to claim 1, wherein groove walls on opposing sides of each of the top surface broken line grooves in the width direction respectively are in smooth connection to the top surface to form an arc-shaped chamfered angle at each of the groove walls on the opposing sides of each of the top surface broken line grooves in the width direction, respectively.

7. The folding fitness mat according to claim 1, wherein the folding fitness mat comprises a foamed material layer, the foamed material layer including any one of PE, XPE, IXPE, EVA, TPE or POE.

8. The folding fitness mat according to claim 7, wherein there are a plurality of foamed material layers, the plurality of foamed material layers being laminated in sequence to form the mat body of the folding fitness mat.

* * * * *